US005133366A

United States Patent [19]

Liebich

[11] Patent Number: 5,133,366

[45] Date of Patent: Jul. 28, 1992

[54] SYSTEM FOR THE MAKING OF CIGARETTES BY THE CONSUMER HIMSELF

[76] Inventor: Max Liebich, Bürgerholzring 9, D-8370 Regen, Fed. Rep. of Germany

[21] Appl. No.: 787,424

[22] Filed: Oct. 15, 1985

[30] Foreign Application Priority Data

Oct. 16, 1984 [DE] Fed. Rep. of Germany ..... 3437882

[51] Int. Cl.[5] ..... A24C 5/00

[52] U.S. Cl. ..... 131/70; 131/71

[58] Field of Search ..... 131/365, 360, 364, 355, 131/187, 70, 329, 71, 76

[56] References Cited

U.S. PATENT DOCUMENTS

| | | | |
|---|---|---|---|
| 33,889 | 12/1861 | Kneeland | 131/360 |
| 3,385,302 | 5/1968 | Wattenford . | |
| 3,688,777 | 9/1972 | Kastner | 131/70 |
| 3,927,681 | 12/1975 | Bramhill | 131/70 |

FOREIGN PATENT DOCUMENTS

| | | |
|---|---|---|
| 3244906 | 12/1982 | Fed. Rep. of Germany . |
| 8309186 | 3/1983 | Fed. Rep. of Germany . |
| 6703935 | 9/1968 | Netherlands . |

*Primary Examiner*—V. Millin

*Attorney, Agent, or Firm*—Ostrolenk, Faber, Gerb & Soffen

[57] ABSTRACT

Systems for the making of cigarettes by the consumer himself comprise a non-smokable prefabricated product, namely an industrially prefabricated sheathed tobacco skein. The sheathed tobacco skein comprises a skein sheath adapted in its diameter to be inserted into the cigarette paper shell of the finished cigarette, having a skein-like tobacco filling corresponding to an individual smoking portion. The non-smokability of the prefabricated product is preferably ensured by a perforation of the skein sheath. The various disclosed systems of the invention are characterized in that for completing the cigarette by the consumer, no axial ejection of the tobacco filling from the skein sheath is necessary.

27 Claims, 6 Drawing Sheets

FIG. 10
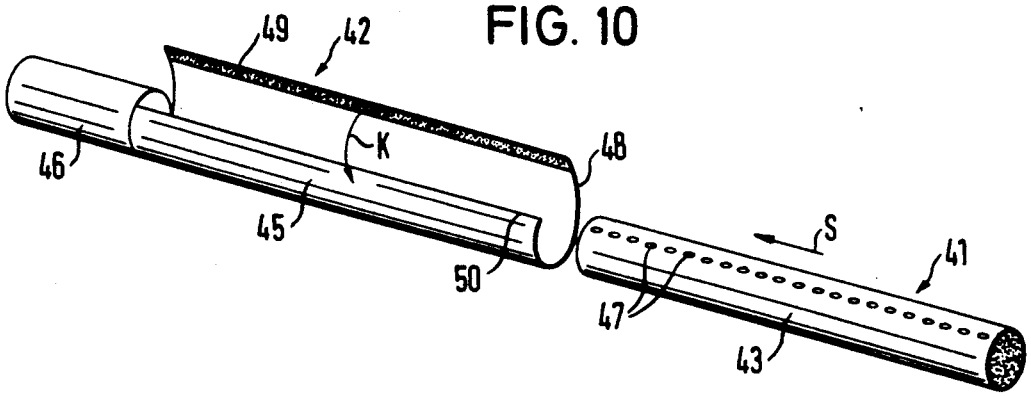
FIG. 11a
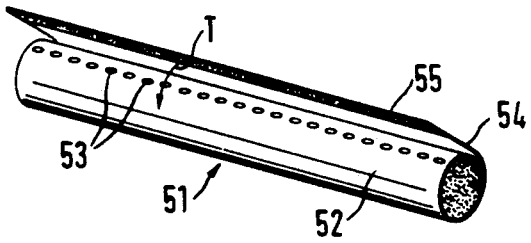
FIG. 11
FIG. 11b
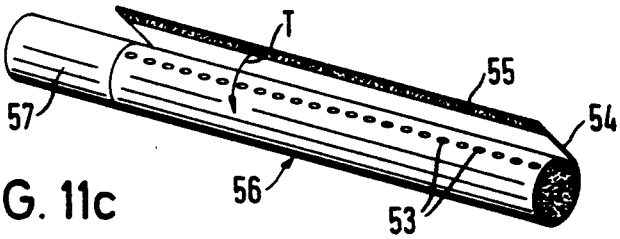
FIG. 11c
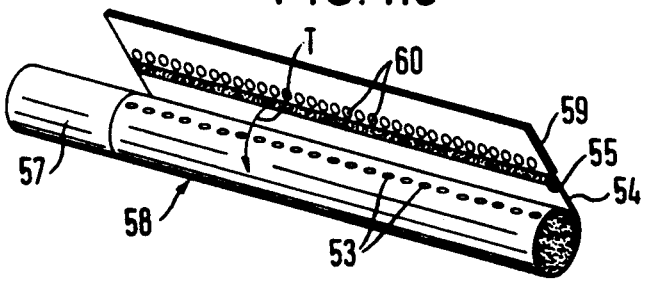

61
62
63
64
65
66
67
68
69
70
71
72
73
74
I
II
III
IV

SYSTEM FOR THE MAKING OF CIGARETTES BY THE CONSUMER HIMSELF

BACKGROUND OF THE INVENTION

The invention relates generally to the making of cigarettes by the consumer himself.

The making of cigarettes by the consumer himself has been known for a long time in a great variety of forms and has never been completely supplanted in spite of the great perfection of the industrial production of conventional finished cigarettes. Recently, the production of cigarettes by the consumer himself has even increased again as a result of both a certain fashion trend (nostalgia wave and) increasingly also of financial considerations and the consumer's wish to economise, particularly because of the drastic price increases for mass-produced industrially made conventional cigarettes. These price increases are due in turn to the relatively high tax to which manufactured cigarettes are subjected in most countries, compared with other tobacco products or tobacco as such.

The making of cigarettes by the consumer himself is done traditionally substantially in two basic forms, that is by the known self-rolling of cigarettes using conventional cigarette papers preferably provided with adhesive edge gumming, and the self-stuffing of cigarettes using commercially available cigarette sleeves (usually with filter piece). Both traditional types of make-your-own cigarettes require considerable manual skill and a certain time expenditure and in some cases particular implements and devices. The cigarettes rolled by hand even by practiced consumers turn out very differently as regards size (diameter), firmness (fullness) and degree of filling over the length of the cigarette, and on the whole form only a primitive substitute for industrially made conventional cigarettes. Also troublesome is the inevitable crumbling of tobacco which also impairs the yield, i.e. the number of cigarettes which can be made by rolling-your-own with a given packet of cigarette fine cut tobacco. By using certain known self-rolling small implements the making of cigarettes by the consumer himself using this method can be simplified to a certain degree, but the necessity of using such implements itself represents a disadvantage, and even rolling cigarettes with such devices still requires a certain manual skill and the uniformity of the cigarettes made therewith by the consumer himself is still not satisfactory. The same applies to the other fundamental type of making of cigarettes by the consumer himself, that is the self-stuffing of cigarettes using commercially available cigarette shells, generally filter cigarette shells, which with the aid of special stuffing devices in the form of small implements are stuffed by the consumer himself. Systems of this type and stuffing devices for them are known for example from Austrian patent 146,213, French patent 427,582 and U.S. Pat. No. 638,904. These self-stuffing methods also require a certain manual skill in manipulating the stuffing device, and the quality of the self-stuffed cigarettes is also not satisfactory as regards uniformity of the degree of filling; here as well, the necessity of using a small implement itself represents a disadvantage, especially since tis substantially restricts the making of cigarettes by the consumer himself to making a stock thereof in advance.

German utility model G 83 09 186.6 discloses a system for the making of cigarettes by the consumer himself in which the consumer is provided with an exactly proportioned amount of tobacco, corresponding for example to the filling of a conventional industrially made cigarette, in the form of an industrially prefabricated sheathed tobacco skein ("cigarette tobacco cartridge") which as such is not smokable. The skein and is open at its end faces and the tobacco filling of which can be transferred in relatively simple manner into a prefabricated (filter) cigarette shell of a usual commercial type or into a cigarette shell gummed from a roll-your-own cigarette paper. For this purpose the system has associated therewith a plunger adapted to the internal diameter of the skein sheath; for making the cigarette by the consumer himself.the prefabricated cigarette tobacco cartridge is introduced in the axial direction into the shell portion of the filter cigarette shell until abutment against the filter portion, and then at the outer projecting end of the tobacco cartridge the associated matching plunger is introduced and with the latter the tobacco filling is transferred by axial ejection from the skein sheath of the prefabricated product into the shell portion of the filter cigarette shell. The sheathed tobacco skein ("cigarette tobacco cartridge") made as an industrial prefabricated product is made so that it is not itself smokable; for this purpose the skein sheath may be made from an incombustible (or hardly combustible) material (for example a thin metal foil) and/or provided with a perforation; when using such a perforation the skein sheath may also be made from a combustible material, for example a plastic foil or also from a (possible metal-coated) paper of adequate strength and stiffness. The formation of the prefabricated sheathed tobacco skein, with a skein sheath of an adequately strong and inherently stiff (and possible perforated) material as prefabricated product not itself smokable, has advantageous functional aspects (good introduceability of the cartridge into the cigarette paper shell and adequate resistance to the stresses on ejection of the tobacco skein filling into the cigarette shell). It has the further advantage that a prefabricated product, not itself smokable, in most countries is subjected to less tax than a conventional industrially made finished cigarette. The prefabricated product in the form of the prefabricated sheathed tobacco skein (cigarette tobacco cartridge) can be made favourably industrially with substantial adoption of the highly sophisticated cigarette manufacturing techniques.

Thus, the system known from German utility model G 83 09 186.6 makes available in technically and economically advantageous manner, to the person making his own cigarettes, the advantages of the highly sophisticated largely automated industrial cigarette production, by supplying to the consumer a preliminary product suitable for the relatively simple production of the cigarette by said consumer. However, in spite of its simplicity this known system still requires a certain manual skill in conjunction with the transferring of the tobacco filling of the cigarette tobacco cartridge into the cigarette paper shell of the finished cigarette, this also requiring an extremely simple implement in the form of a plunger for the axial ejection of the cigarette filling out of the cartridge into the cigarette paper shell. This transfer by an ejection operation also involves certain restrictions on the skein sheath of the prefabricated product; the latter must firstly have good sliding properties to enable introduction into the cigarette paper shell in the narrowest possible fit; it should also have a certain inherent stiffness which is not too low and have adequate tensile strength to withstand the stresses in the axial transfer of the tobacco filling to the cigarette paper shell. For this reason, in the practical execution of the known system a relatively still material of adequate tensile strength, for example in the form of a metal-laminated paper composite material, is provided for the skein sheath, which on the production side requires certain interventions in the manufacturing techniques otherwise largely adopted from the highly sophisticated industrial cigarette production. In addition, if the manipulation is not carried out quite properly or is conducted somewhat inattentively, certain irregularities or imperfections can arise in the transfer of the tobacco filling to the cigarette paper shell. For instance, the axial region of the filter paper shell remote from the introduction end and adjoining the filter portion may not be filled or may not fully firmly filled, and at the introduction end of the cigarette shell some tobacco may drop out.

A generally similar system using an industrially prefabricated cigarette, tobacco cartridge not as such smokable, and in the form of a sheathed tobacco skein open at the end sides, is also known from U.S. Pat. No. 3,822,710 and 3,927,681 (both in the name of Bramhill). The making of the final cigarette by the consumer himself in this known system is however substantially more complicated. It requires a relatively sophisticated separate means in which, in a complicated and involved operation, the skein sheath (preferably consisting of cellophane or a plastic foil) of the tobacco cartridge must be withdrawn in axial direction between an outer pushed-on cigarette paper shell and the inner tobacco filling.

German laid-open specification DE-OS 3,244,906 (in the name of Hofmann and Schrader) finally also discloses the general concept of forming preliminary portions by the manufacturer of amounts of tobacco corresponding to a cigarette filling, it also being mentioned that the individual portions can be sheathed with conventional cigarette paper rendered non-drawable. No information is given on the nature of the further processing of these preportioned units made by the manufacturer to give a finished cigarette made by the consumer himself.

SUMMARY OF THE INVENTION

Thus, proceeding from utility model G 83 09 186.6 (Max Liebich) the invention relates to a system for the making of cigarettes by the consumer himself using a prefabricated product, not in itself smokable, in the form of a manufactured prefabricated sheathed or enveloped tobacco skein comprising a skein sheath adapted in its diameter to the cigarette paper shell of the finished cigarette and comprising a skeinlike tobacco filling corresponding to the respective cigarette portion, the non-smokability of the prefabricated product being ensured by a perforation of the skein sheath.

The problem underlying the invention is the provision of a system of this type which retains the fundamental advantages outlined above of the making of cigarettes by the consumer himself using a prefabricated sheathed tobacco skein as industrial prefabricated product; but is even simpler and more reliable for the consumer in use of in particular, the problems involved with the transfer of the tobacco filling into the cigarette paper shell of the finished cigarette are to be avoided or substantially reduced.

For this purpose, according to a basic embodiment of the invention, the skein sheath consisting of a combustible and smokable material, in particular a thin cigarette paper, after introduction of the prefabricated product into the cigarette paper shell remains in the latter and forms together with the latter the envelope of the finished cigarette; preferably, the prefabricated product may be formed with a slight subsequent variability of its diameter by the user, said diameter variability preferably being obtained by a special arrangement and formation of the perforation of the skein sheath, for example by a linear arrangement of closely adjacent perforation openings, in particular in the form of a helical line extending over the axial length of the prefabricated product.

Since according to this embodiment the skein sheath consists of a combustible and physiologically tolerable smokable material, in particular a cigarette paper, the skein sheath in the finished cigarette can remain as also smokable component and a transfer of the tobacco filling into the cigarette paper shell of the finished cigarette is superfluous. This in turn has the result that the skein sheath, which is not of course hereby subjected to any increased stress by an (axial) transfer of the tobacco skein, can consist of a relatively thin cigarette paper so that on corresponding formation of the associated filter cigarette shell with likewise lesser cigarette paper thickness than in commercially available shells the double-walled enclosure of the finished cigarette consisting of the outer cigarette paper shell and the skein sheath of the prefabricated product corresponds as regards total paper weight and physiological and taste combustion values substantially to the cigarette paper shell of a conventional manufactured cigarette.

Handling of the system according to the invention is extremely simple to the user because a physical axial transfer of the tobacco filling from the skein sheath to the cigarette paper shell is dispensed with. The prefabricated product need only be introduced by the user into the shell portion of the associated filter cigarette shell, and by the preferably provided slight diameter variability of the prefabricated product on the one hand the introduction operation is facilitated and on the other hand in the inserted state a firm complete engagement of the skein sheath of the prefabricated product against the inner side of the outer cigarette paper shell can be achieved in such a manner that the perforation openings of the skein sheath are sealed and the previously unsmokable prefabricated product is converted to the smokable end product. The formation of the perforation as helical line extending over the axial length of the prefabricated product permits, in conjunction with the thinness of the skein sheath material, in simple manner diameter variability in both directions (reduction and increase) by corresponding twisting of the sheathed tobacco skein in or against the direction of rotation of the perforation helix line.

For the production the formation of the skein sheath from a (thin) cigarette paper has the advantage of a still further adaptation to the conditions of conventional industrial manufactured cigarette techniques so that the highly sophisticated production techniques can be largely adopted for the production of the preliminary prefabricated product.

For facilitating the initial introduction of the sheathed tobacco skein into the cigarette paper shell a "sharpening" of the preliminary prefabricated product may be provided by a slight conical inward edging of the skein sheath at the introduction end face, and this "sharpening" can be carried out in simple manner by the consumer by a corresponding turn-in depression integrated in the package container or in a correspondingly marked corner of the pivot lid of the package.

The system is also suitable for use in conjunction with roll-your-own cigarette paper as outer cigarette paper shell of the finished cigarette, the prefabricated sheathed tobacco skein simply being wrapped round with a cigarette paper of type known per se, preferably in thinner form, and the cigarette paper adhered in the usual manner.

Altogether, the system according to the invention corresponding to the basic embodiment described above permits in the simplest possible manner, starting from an industrially premade sheathed tobacco skein as prefabricated product, the making of a cigarette by the consumer himself which as regards dimensional stability, firmness, uniformity of the degree of filling, smokability and general appearance is completely equivalent to conventional industrially made commercial cigarettes. Since the industrially prefabricated sheathed tobacco skein in this basic embodiment is retained unchanged in the final cigarette made by the user, in particular no transfer of the tobacco filling in the axial direction out of the sheath into the cigarette shell is necessary, the cigarette made by the user himself has with regard to the tobacco filling the same high quality as the prefabricated product which can be optimized under the exactly controllable conditions of the sophisticated industrial production. In this embodiment of a system according to the invention no additional implement or aids whatever are required so that the making of the cigarette by the consumer himself from the two components, prefabricated sheathed tobacco skein and filter shell, is fundamentally possible at any time and at any place.

To solve the problem underlying the invention according to a second fundamental embodiment of a system according to the invention it may also be provided that the skein sheath of the prefabricated sheathed or enveloped tobacco skein is formed with a tongue or tab portion projecting outwardly from the closed periphery, that the filter cigarette shell is formed at least over its shell portion unadhered with an axial longitudinal slot, from which one edge projects as adhesive edge, and that as aid for the making of the cigarette by the consumer himself from the sheathed tobacco skein and the filter cigarette shell a tube provided with a longitudinal slot and consisting of a resilient flexible material is provided whose axial length corresponds substantially to the length of the sheathed tobacco skein and of the shell portion of the filter cigarette shell.

The method of making the cigarette by the consumer himself using this basic embodiment of the invention includes the following method steps: The prefabricated sheathed or enveloped tobacco skein is introduced into the shell portion of the filter cigarette shell in axial direction in such a manner that the tongue or tab portion of the prefabricated product projects outwardly through the longitudinal slot of the shell portion of the cigarette filter shell, the cigarette filter shell is introduced with the prefabricated product inserted therein in axial direction into the slit tube so that the tongue or tab portion projecting from the periphery of the skein sheath of the prefabricated product through the slot of the shell portion of the cigarette filter shell and the adhesion edge of the shell portion of the cigarette filter shell projecting from the periphery of the cigarette filter shell outwardly project through the longitudinal slot of the slit tube outwardly, the introduction in the axial direction being effected to such an extent that the prefabricated product with the cigarette paper shell surrounding it are enclosed in the slit tube whilst the filter portion of the cigarette filter shell projects at one end of the slit tube, by pulling outwardly on the outwardly projecting tongue or tab portion of the skein sheath of the prefabricated product the adhesion or fusion seam and/or the desired tear point of the skein sheath is separated, by further pulling on the tongue or tab portion the skein sheath is withdrawn completely from the longitudinal slots of the slit tube and the cigarette paper shell outwardly, by relative turning of the slit tube with respect to the cigarette filter shell the outwardly projecting adhesion edge of the cigarette paper shell is folded over inwardly to coincide with the other slot edge of the cigarette paper shell and stuck to the latter by means of the (possible previously activated) adhesive layer.

With this other basic embodiment of the system according to the invention described above it is also possible in extremely simple manner to make a high quality cigarette equivalent in every respect to industrially produced finished cigarettes, starting from the industrially prefabricated sheathed tobacco skein, and in accordance with the fundamental idea of the invention without axial transfer of the tobacco filling from the skein sheath, in such a manner that the tobacco skein in its firmness and consistency is retained unchanged from the condition in the industrial manufacture of the prefabricated product. The slit tube required by the user in this basic embodiment for making his own cigarettes represents an aid of the simplest possible type which in addition in its form and dimensions largely corresponds to the prefabricated product and the matching cigarette shell and consequently is well suited to be included in a corresponding packet container.

Further advantageous basic embodiments of a system according to the invention are the subjects of claims 13, 14, 21 and 24; the procedures adopted by the consumer for making his own cigarettes in accordance with some of these basic embodiments are set forth in method claims 20 and 26.

BRIEF DESCRIPTION OF THE DRAWINGS

The invention will be described in detail hereinafter with the aid of the drawings, FIGS. 1 to 7 referring to a first basic embodiment of the invention, FIGS. 8 and 9 to a second basic embodiment, FIG. 10 to a particularly advantageous modified embodiment of the first basic embodiment, FIG. 11 to a particularly advantageous modification of the second basic embodiment and FIG. 12 to a further basic embodiment of a system according to the invention. In particular, FIG. 10 is a perspective view of the components of a system according to the invention corresponding to an advantageous modification of the first basic embodiment, FIG. 11 with its subfigures 11*a*, 11*b* and 11*c* each show in perspective view a particularly advantageous modification of the second basic embodiment of the invention, and FIG. 12 with its subfigures 12*a*, 12*b* and 12*c* shows the essential components of a further basic embodiment of a system according to the invention.

DETAILED DESCRIPTION OF THE PREFERRED EMBODIMENTS

Hereinafter, with the aid of FIGS. 1 to 7 a preferred embodiment of a system according to the first solution proposal of the invention will first be described.

Figure 1:
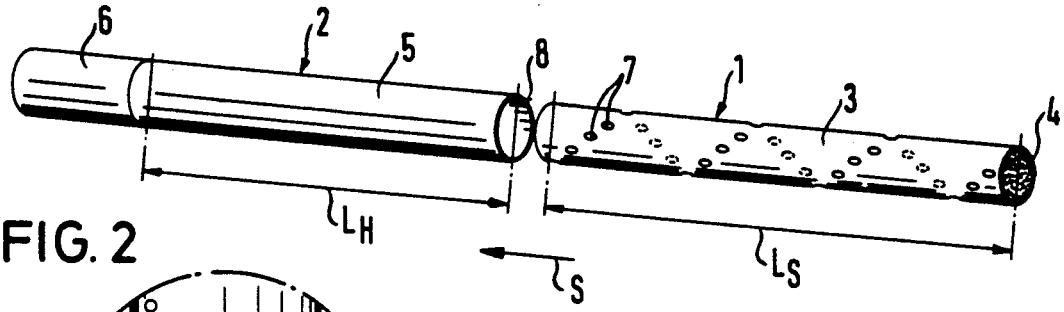
FIG. 1 shows in perspective view the fundamental components of a first basic embodiment of a system according to the invention, that is the prefabricated sheathed tobacco skein and associated filter cigarette shell.

FIG. 1 illustrates in schematic view the essential components of such an embodiment of the system according to the invention which includes a sheathed tobacco skein (designated as a whole by 1 in FIG. 1) industrially made as prefabricated product in association with a filter shell of conventional type designated as a whole by 2. The prefabricated product 1 consists of a skein sheath 3 having a skeinlike tobacco filling 4 (inserted by the manufacturer). The prefabricated product 1 has an axial length $L_S$ which is preferably somewhat greater than the axial length $L_H$ of the hollow portion 5 of the filter shell 2, that is, without the usual filter portion 6 of the filter shell 2.

The skein sheath 3 consists according to the invention of a combustible material which is also smokable, regards health and flavour aspects, preferably a high-quality cigarette paper of conventional type with the smallest possible thickness. The cigarette paper used for the skein sheath 3, or other equivalent material as regards its physical, physiological and flavour combustion and smokability properties, is preferably made as thin as possible, i.e. so that with regard to its strength values it is just adequate to permanently enclose the tobacco skein. An elevated tensile strength, which have necessary in the known systems which have axial transfer of the tobacco skein from the skein sheath to the cigarette shell, is not necessary here.

The same applies to the material of the shell portion 5 of the filter shell 2; the filter shell 2 may fundamentally be a filter shell of conventional type. However, preferably the paper thickness for the shell portion 5 of the filter shell of the system according to the invention is made less than in conventional shells; in the system according to the invention the shell is not subjected to any increased tensile stresses by axial transfer of the tobacco skein into the shell; the only requirement is an adequate stability of the shell on initial introduction of the sheathed tobacco skein. According to a particularly preferred embodiment, the filter shell and the skein sheath of the system according to the invention have together substantially the thickness (paper weight) of a cigarette paper of a conventional industrially made cigarette or a conventional filter shell for self-stuffing.

The skein sheath 3 of the sheathed tobacco skein 1 made as prefabricated product industrially is provided with a perforation 7. This guarantees firstly the required non-smokability of the prefabricated product 1 (so that the latter is not subjected to the tax imposed on finished cigarettes, which as a rule is higher), and secondly the perforation serves in the system according to the invention at the same time, in conjunction with the aforementioned particularly thin material of the skein sheath 3, to obtain a certain variability of the diameter of the sheathed tobacco skein 1 by the user (cigarette maker). In the example of the embodiment illustrated, in accordance with a preferred embodiment the perforation 7 is formed in a particular manner, i.e. in the form of a helical line extending over the axial length of the skein sheath. In particular, in the example of embodiment shown in FIG. 1, the perforation 7 is formed, seen in the direction of the arrow S of the subsequent introduction of the sheathed tobacco skein 1 into the associated filter shell 2, as a right-handed helical line. Of course, the perforation could equally well be made as a left-handed helical line. The "pitch" of the helical line, i.e. the number of convolutions present over the entire length $L_S$ of the skein sheath, is not subjected to any exact limits; fundamentally, even the formation as a perforation line with only one convolution over the axial length of the skein sheath, in conjunction with correspondingly thinner material of the skein sheath, can ensure adequate diameter variability. However, preferably the perforation line is formed with a plurality of convolutions over the axial length $L_S$ of the skein sheath. If a larger number of perforation openings than that practically obtainable with a single helix line is desired it is also possible to provide a plurality of helical perforation lines, these preferably all being made in the same sense (either right-handed or left-handed). Possibly, with such embodiments with a plurality of perforation helical lines the individual helical lines may also be formed in opposite directions of rotation but preferably a majority of the helical lines is formed in the same direction of rotation (right-handed or left-handed).

The preferred formation of the perforations as one (or more) helical lines in the manner of the helical line 7 of FIG. 1 has the advantage explained in detail below in conjunction with the description of the making of the cigarette of a certain diameter variability by the user in both directions, i.e. in the sense of a reduction (becoming thinner) and increase (becoming thicker) of the skein diameter. However, the invention is not restricted to the preferred formation of the perforations in helical line form. For example, perforations formed in circular lines in planes substantially perpendicular to the longitudinal axis of the skein, in conjunction with the thin material of the skein sheath 3, also provide a certain controllable diameter variability of the skein; this applies similarly to perforations not arranged in line form but in accordance with some other pattern or even at random.

Figure 2:
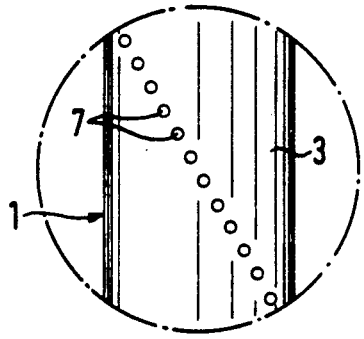
FIG. 2 shows in schematic detail side elevation a fragment of the prefabricated product according to the invention with the perforation of the skein sheath.

In the mass production of the sheathed tobacco skein 1 the perforations 7 are introduced from the outside of the envelope so that the "burr" produced in the production of the perforations does not restrict the slidability of the skein on subsequent introduction into the cigarette shell. FIG. 2 illustrates, in the form of a schematic fragment outer view, the perforation when the holes are in the form of a (helical) line. As apparent the individual perforation holes through the skein sheath are relatively close together, a lower limit for the hole intervals being set by the need to ensure adequate stability of the skein sheath. It should be mentioned in this connection that any tearing of the skein sheath during or after the introduction into the filter shell (cf. FIGS. *3b* and *c*) does not impair the function of the system according to the invention because in the finished product the skein sheath is of course surrounded on the outside by the filter shell.

Figure 3A:
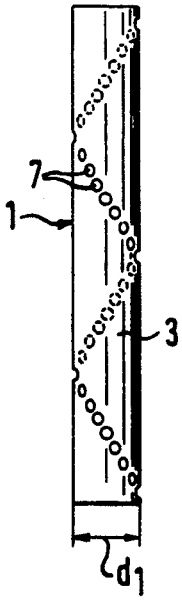
FIG. 3 illustrates in its subfigures 3*a*, 3*b* and 3*c* the procedure in making the cigarette by the consumer in various stages of the method.
Figure 3B:
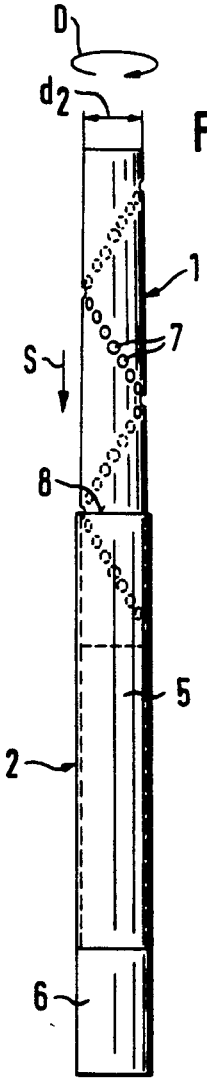
Figure 3C:
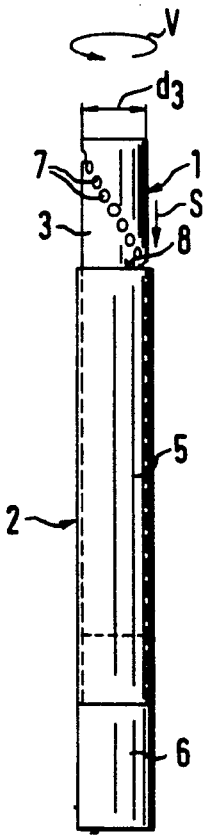

Hereinafter with the aid of FIG. 3 the making of a cigarette by the consumer himself using the system according to the invention will be explained. FIG. 3 illustrates once again in schematic side view the sheathed tobacco skein employed as industrially made prefabricated product as the essential component of the system according to the invention. This sheathed tobacco skein is made by the manufacturer with a diameter $d_1$ which is slightly less than the internal diameter of the filter shell 5. FIG. *3b* shows the condition at the start of the making of the cigarette by the consumer, the sheathed tobacco skein 1 being introduced a distance into the open end face 8 of the filter shell 5. To facilitate the introduction operation before or during the introduction the diameter of the tobacco skein can be reduced slightly to a value $d_2$ by twisting the tobacco skein itself slightly in the direction of rotation corresponding to the sense of the helical line, i.e. in the illustration in FIG. 3 by twisting clockwise with respect to the introduction direction (arrow S) in accordance with the rotation arrow D. For this purpose the end of the sheathed tobacco skein introduced (or to be introduced) into the skein shell 5 is held and at the opposite (upper) end a slight twist is exerted in the aforementioned direction of rotation according to the arrow D; this results, due to the (helical) perforation 7 in conjunction with the small material thickness of the skein sheath 3 and the certain compressability of the skein filling, in a tapering or slimming of the sheathed tobacco skein down to the aforementioned diameter $d_2$ which may be somewhat smaller than the original diameter $d_1$ set in the manufacturing process and facilitates the introduction of the sheathed tobacco skein into the filter shell 5 in such a manner that the introduction can take place without any aids whatever.

FIG. *3c* illustrates the condition in which the sheathed tobacco skein 1 is already largely introduced into the filter shell 5 and only a small portion thereof projects from the upper end of the filter shell. In this condition by twisting the tobacco skein 1 oppositely to the sense of the perforation helical line 7, i.e. in the direction of the arrow V in FIG. *3c*, the diameter of the sheathed tobacco skein can be slightly increased (cf. $d_3$ in FIG. *3c*) in such a manner that the tobacco skein expanding slightly radially corresponding to the diameter increase presses with its outer side in firm engagement against the inner wall of the filter shell 5. By complete insertion of the sheathed tobacco skein over the remaining distance, possibly also by "tapping" as known with filterless cigarettes, the making of the cigarette with the system according to the invention is completed and normal smoking now possible, the skein sheath 3 remaining in the finished cigarette and being smoked together with the filter shell 5 and tobacco filling 4. Due to the diameter variation made possible according to the invention and the resulting full engagement of the skein sheath 3 with the filter shell 5 in the completely inserted state, any impairment of the smoking by the perforation of the skein sheath remaining in the shell is avoided.

According to a modification of this embodiment of the system, according to the invention shown in FIG. 10, there is associated with the prefabricated sheathed tobacco skein, which is designated as a whole by 41 and which again comprises a skein sheath 43 of a thin smokable and combustible materials, such as a special cigarette paper, a filter cigarette shell designated as a whole by 42 which is not adhered at least in its shell portion 45. The one projecting longitudinal edge 48 of the shell 42 is provided with a gumming 49 for subsequent sticking of the cigarette shell. In FIG. 10 only the shell portion 45 unadhered is made with longitudinal slot whilst the filter portion 46 is finished with an adhered paper wrapping. However, the paper wrapping of the filter portion 46 could also be unadhered and made with a projecting gummed portion corresponding to the projecting gummed edge 48, 49 of the shell. To complete the cigarette the sheathed tobacco skein 41 is introduced in the direction of the arrow S into the shell portion 45, this introduction being particularly simple because of the initially unadhered open form of the shell 45. Then in the completely inserted condition of the prefabricated product 41 in the shell portion 45, the latter is then wound in the manner know per se in the rolling of cigarettes by the consumer himself tightly about the skein sheath 43 of the prefabricated product 41. That is the projecting adhesive edge 48, 49 is folded over in the direction of the arrow K onto the opposite longitudinal edge 50 and stuck to the latter. As in the adhered state, the cigarette shell 45 encloses the skein sheath 43 of the prefabricated product 41 in tight engagement so that during smoking no air can be drawn in incorrectly. No diameter variability of the prefabricated product 41 is necessary in this embodiment and accordingly the perforation 47 of the prefabricated product may be made in the manner shown, as a perforation line along a generatrix, or in any other desired manner.

Figure 4:
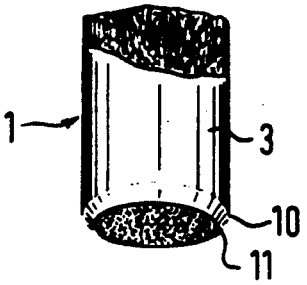
FIG. 4 is a perspective view of a detail according to a preferred embodiment.
Figure 5:
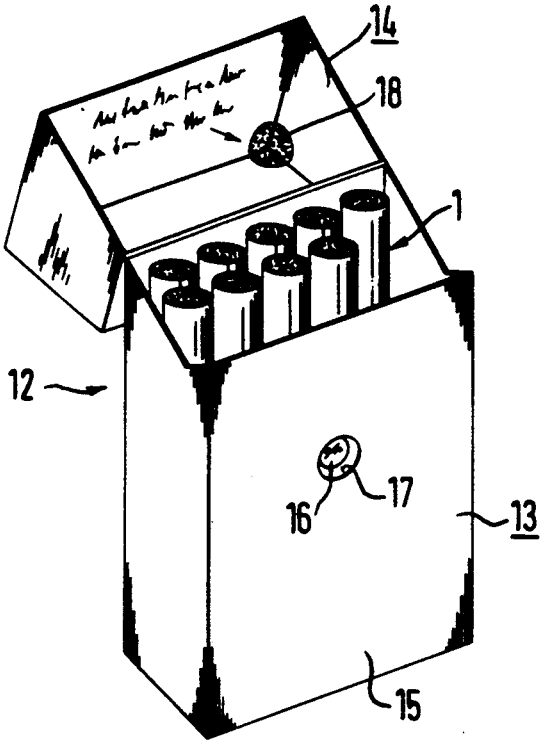
FIG. 5 is a perspective view of a packet container for prefabricated products of the system according to the invention with an aid in the container for "sharpening" the sheathed tobacco skein at its insertion end (according to FIG. 4)
Figure 6A:
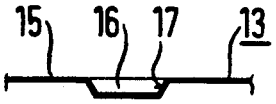
FIG. 6*a* is a partial sectional view of the container front side.
Figure 6B:
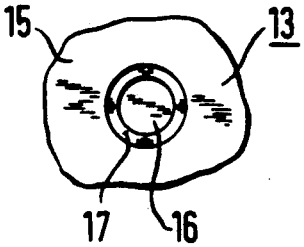
FIG. 6*b* represents a corresponding detail plan view, FIG. 7 show sin perspective view the use of the prefabricated sheathed tobacco skein in conjunction with roll-your-own cigarette paper, FIG. 8 with its subfigures 8*a*, 8*b*, 8*c* each show in perspective view the components of a second basic embodiment of a system according to the invention.

To facilitate the initial introduction of the sheathed tobacco skein 1 into the open end face 8 of the shell portion 5 of the filter shell 2 the tobacco skein 1 may be "sharpened" at its insertion end 10 (cf. FIG. 4), i.e. the skein sheath 3 can be slightly inwardly bevelled at the insertion end 10 as indicated at 11 in FIG. 4. This sharpening may possibly be made by the manufacturer himself but according to a preferred embodiment of the system according to the invention can be carried out in simple manner by the user as well with the aid of a configuration integrated in the packet of the sheathed tobacco skeins 1 made by the manufacturer, as illustrated in FIG. 5. FIG. 5 shows in perspective view one possible embodiment for this purpose. The sheathed tobacco skeins 1 made by the manufacturer are preferably, as stated, supplied similiarly to finished cigarettes of conventional type packed in a container 12 which corresponds to a conventional cigarette packet. The container 12 has, for example, a pivotal lid and in the example of the embodiment illustrated consists of the lower portion 13 accommodating the sheathed tobacco skeins 1 over the major part of their length and a pivotal lid portion 14. At one of the walls of the lower portion 13, for example at the one major front face 15 visible in FIG. 5, a pot-shaped depression 16 with a side face 17 extending conically towards the bottom is formed; this "sharpening" depression 16 is illustrated in FIGS. 6*a* and 6*b* in partial section and partial plan view. By pressing the sheathed tobacco skein 1 taken from the packet into said opening with simultaneous turning the user can rapidly in simple manner obtain the conical form 11 (FIG. 4) at the insertion end of the skein 1.

The same effect can be achieved in still simpler manner by corresponding "turning in" of a sheathed tobacco skein 1 into one of the corners of the lid 14 exposed when said lid is in the open condition. For this purpose, one of the corners of the pivot lid 14, for example the corner visible at the top right in FIG. 5, may be correspondingly marked by the manufacturer, for example with a colour dot 18 and corresponding inscription.

The system according to the invention corresponding to the one basic embodiment described above therefore permits in the simplest possible manner, starting from an industrially prefabricated sheathed tobacco skein as preliminary product, the making of a cigarette by the consumer himself which as regards dimensional stability, strength, uniformity of the degree of filling, smokability and general appearance is completely equivalent to conventionally industrially made finished cigarettes. Since the industrially produced sheathed tobacco skein 1 in this basic embodiment of the system according to the invention is retained unchanged in the final cigarette made by the consumer himself, and in particular no transfer of the tobacco filling of the sheathed tobacco skein in the axial direction out of the sheath into a cigarette shell is necessary, the cigarette made by the user himself has as regards the tobacco filling the same high quality as the prefabricated product which can be set under the exactly controllable conditions of sophisticated mass production. For making the final cigarette from the industrially prefabricated preliminary product the user does not require any implement aids whatever and consequently the cigarette can be made by the consumer from the two components, prefabricated sheathed tobacco skein 1 and filter shell 2, fundamentally at any time and at any place. The sheathed tobacco skeins 1 and the associated particularly adapted filter shells are preferably available in matching packets in the form of conventional cigarette packets and filter shell packets which can easily be carried around by the user. There is of course also the possibility of the user making a stock of cigarettes so that for example several or all the sheathed tobacco skeins of a packet are combined with the corresponding associated filter shells and the cigarettes finished by the user himself conveniently carried about in one of the two packets (skein packet or cigarette shell packet) in the manner of conventional cigarette packets.

Figure 7:
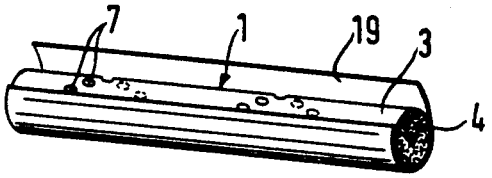

The system according to the invention corresponding to the basic embodiment described above is moreover suitable in identically simple manner also to the making of filterless cigarettes by the consumer himself by "rolling" as illustrated in FIG. 7. For this purpose a sheathed tobacco skein 1 of the same type as that illustrated in FIG. 1, i.e. comprising a skeinlike tobacco filling 4 in a thin sheath 3 of fine cigarette paper is wrapped in a cigarette paper 19 of conventional type and the cigarette paper 19 adhered in the usual manner. The sheathed tobacco skein is again provided with a perforation 7 so that as such it is not smokable. Since in this type of use for rolling-your-own the variability of the skein sheath diameter does not play an essential part, the perforation here can be made fundamentally in any desired manner. It is however conveniently also present in the helical line form described for the embodiment according to FIGS. 1 to 6 so as to enable one and the same sheathed tobacco skein prefabricated product to be used for "stuffing" and "rolling".

Figure 8B:
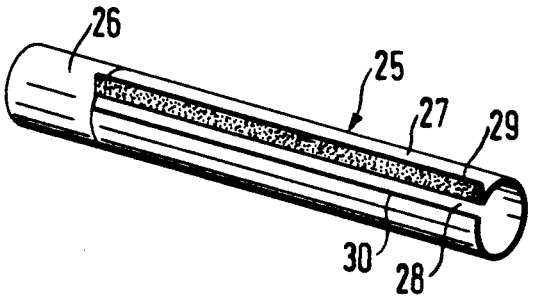
Figure 8A:
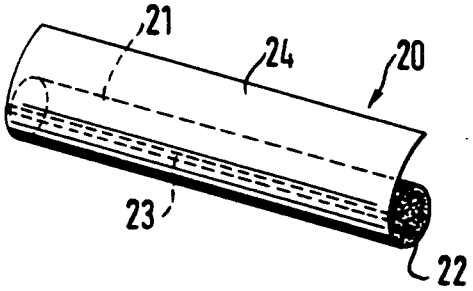
Figure 8C:
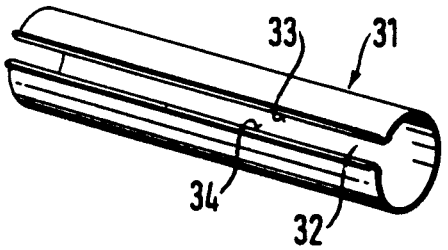
Figure 9:
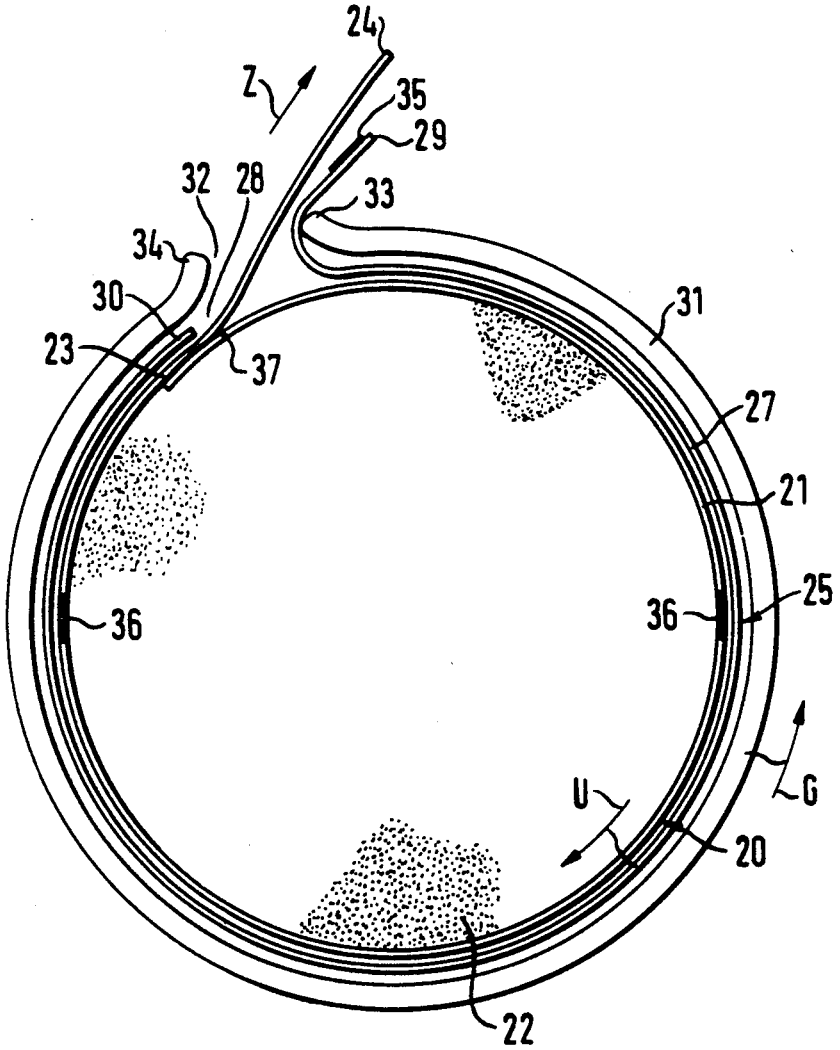
FIG. 9 shows in enlarged cross-sectional view the components of the system according to the invention corresponding to FIG. 8 in their mutual association and their co-operation in the making of the cigarette by the consumer himself.

Another basic embodiment of a system according to the invention for the making of cigarettes by the consumer himself using a prefabricated sheathed tobacco skein is illustrated in FIGS. 8 and 9. In this embodiment as well, as with the fundamental idea underlying the solution of the present invention, no axial transfer of the tobacco filling from the prefabricated product (sheathed tobacco skein) into the cigarette shell (or the roll-your-own cigarette paper) is necessary.

FIG. 8 illustrates the basic components of the system of the invention corresponding to this other basic embodiment. The system includes a sheathed tobacco skein manufactured as industrial prefabricated product and designated as a whole by 20 (FIG. 8*a*) and having a special form a cigarette filter shell of particular type designated as a whole by 25 (FIG. 8*b*)

a tube 31 (FIG. 8*c*) with longitudinal slot used as aid for the user in the making of the final cigarette by him according to this system.

The sheathed tobacco skein 20 again consists of a skein sheath 21 and a tobacco skein 22 enclosed by said sheath. However, in deviation from the sheathed tobacco skein 1 of the embodiment described above with reference FIGS. 1 to 7 in the embodiment according to FIGS. 8 and 9 the skein sheath 21 continues somewhat beyond the adhesion or fusion seam 23 extending in the axial direction, thus forming a tongue or tab 24 projecting somewhat from the periphery of the sheathed tobacco skein. Once again the sheathed tobacco skein 20 as a whole is not smokable and need not be combustible; the non-smokability of the sheathed tobacco skein as such can either be ensured by choosing a corresponding non-combustible or sparingly combustible material for the skein sheath 21 and/or by a perforation. In particular, the skein sheath 21 could consist for example of a plastic foil material, a metal foil or a paper lined with metal, possibly also of a combustible material, or even of a cigarette paper, but the skein sheath material should have adequate strength for the subsequent removal from the tobacco skein in the manner described below with reference to FIG. 9.

The cigarette filter shell 25 representing a further component of the system according to this basic embodiment and formed in a manner differing from the usual comprises a filter portion 26 of conventional type and a shell portion 27 which is provided over its axial length with a slot 28, one longitudinal edge 29 of the filter shell paper being provided with gumming but not adhered to the opposite edge 30 of the shell paper. In the illustration of FIG. 8*b* the slot 28 extends only over the axial length corresponding to the shell portion 27 of the filter shell 25; however, the paper wrapping of the filter piece 26 could also be made unadhered in continuation of the slot 28 and have a projecting gummed portion corresponding to the projecting gummed edge 29 of the shell.

A further component of this other embodiment of the system according to the invention comprises a tube which is designated as a whole by 31 in FIG. 8*c* and consists of a resilient, preferably resilient-yieldable material such as cardboard, plastic or metal, whose diameter is somewhat greater than the filter shell and whose axial length is somewhat greater than the shell portion 27 of the cigarette filter shell 25 but preferably somewhat smaller than the axial total length of the cigarette filter shell 25 in such a manner that in the inserted condition of the cigarette filter shell (with the sheathed tobacco skein introduced previously into the latter, cf. below) the shell portion 27 lies over its entire length in the tube 31 but the filter portion 26 of the filter shell projects at one end face of the tube 31. The tube 31 is provided over its entire axial length with a slot 32. The longitudinal edges 33, 34 forming the slot 32 are made slightly outwardly bent and rounded (cf. also the illustration on an enlarged scale in FIG. 9) to ensure smooth functioning in the making of the cigarette by the consumer himself as described below. This slit tube 31 is an aid of the simplest possible type to the user when making the final cigarette; this simple aid is not comparable to the substantially more complicated implements like the previously known self-stuffing or self-rolling devices mentioned at the beginning. Compared with the displacement plunger used in the known system according to utility model G 83 09 186, 186, this system has the advantage of a shorter length, corresponding substantially to the length of the sheathed tobacco skeins, so that the slit tube could be included for example in simple manner in the respective packet of sheathed tobacco skeins and/or associated packet of filter cigarette shells.

Hereinafter, with the aid of FIG. 9 the operation in the making of the finished cigarette by the user himself with the system of FIG. 8 will be explained. For this purpose, firstly the sheathed tobacco skein 20 of FIG. 8*a* is introduced into the shell portion 27 of the filter cigarette shell 25 (in FIG. 8*b*) in such a manner that the projecting unadhered tabs 24 at the periphery of the skein 20 extend through the slot 28 of the cigarette shell. The aggregate consisting of the cigarette filter shell 25 and the sheathed skein 22 inserted therein is then introduced in the axial direction into the slit tube 31 (FIG. 8*c*) so that the tabs 24 projecting from the periphery of the skein sheath and the adhesion edge 29 of the filter shell outwardly projecting from the periphery of said filter shell extend through the slot 32 of the tube 31. The shell portion 27 with the sheathed tobacco skein 20 disposed therein comes to lie over its entire length in the slit tube 31, the filter portion 26 of the filter shell 25 projecting at least partially at one end out of the slit tube 31.

This condition of the filter shell inserted into the slit tube with the sheathed tobacco skein disposed therein is shown in an enlarged cross-sectional view in greater detail in FIG. 9. As apparent, the following parts are present in the direction radially from the outside to the inside: the whole is enclosed on the outside by the slit tube 31 whose edges 33, 34 slightly outwardly bent and rounded in the manner described form and define the longitudinal slot 32. There then follows the shell portion 27 of the cigarette filter shell in such an arrangement that the gummed outwardly projecting slot edge 29 of the shell portion 27 projects outwardly through the slot 32 of the slit tube, bearing substantially on the slot edge 33 of said slit tube 31, whilst the slot edge 30 of the shell portion 27 opposite the adhesion edge 29 terminates substantially in the region of the slot edge 34 of the slit tube 31. The slot 28 of the shell portion 27 of the cigarette filter shell 25 is thus aligned with the slot 32 of the slit tube 31. The outwardly projecting adhesion edge 29 of the shell portion 27 is provided with the adhesive coating 35 designated particularly in FIG. 9.

There then follows radially inwards the skein sheath 21 of the prefabricated sheathed tobacco skein 20 with the inner tobacco filling 22. The projecting tab 24 of the skein sheath 21 projects outwardly through the slot 28 of the shell portion 27 and the slot 32 aligned therewith of the slit tube 31 and with its greater extent convers the projecting adhesion edge 29, 35 of the shell 27. The adhesion or fusion seam 23 of the skein sheath 21, which comes to lie approximately below the edge 34 of the tube slot 32, is clearly apparent in FIG. 9. At 36 in FIG. 9 a perforation of the skein sheath is indicated if required or indeed provided for ensuring the non-smokability of the prefabricated product.

The subsequent making of the cigarette from the condition illustrated in FIG. 9 takes place in the simplest possible manner in that the projecting tab 24 of the skein sheath is pulled in the direction of the arrow Z; the adhesion or fusion seam 23 of the industrially prefabricated tobacco skein is formed such that it detaches itself under the action of the pull Z; in addition, according to an advantageous further development it is possible to provide a desired tear point 37 in the region of the adhesion or fusion seam 23 in the lower layer of the skein sheath. By further pulling of the tab 24 the skein sheath thus separated can be completely withdrawn from the slit tube 31 through the slot 32. Preferably, the outwardly projecting adhesion edge 29 of the filter shell 27 is to be pressed round the slot edge 33 of the tube 31 against the latter to hold the filter shell 27 in its peripheral position. This arresting of the filter shell 27 can also be effected or additionally enhanced by withdrawing the projecting tab 24 of the skein sheath after detachment of the adhesion or fusion seam 23 in a more tangential direction so that the projecting adhesion edge 29 of the shell 27 is pressed by the withdrawn skein sheath 21 thereabove against the slot edge 33 of the slit tube and the shell 27 thus fixed in its position in the tube 31. After the complete withdrawal of the skein sheath 21 through the tube slot 32 the tobacco skein 22 now fills the shell portion 27 of the cigarette shell 25, this being achieved in accordance with the fundamental idea of the present invention without an axial transfer of the tobacco skein 22 from the skein sheath 21 over the entire axial length thereof.

As last step, the outwardly open adhesive coating 35 of the projecting adhesion edge 21 of the filter shell 27 is now moistened and the cigarette filter shell 25 turned at the filter portion 26 projecting outwardly from the slit tube 31 in said tube in the direction of the arrow U (i.e. clockwise in FIG. 9); the projecting adhesion edge 29 of the shell 27 is automatically drawn into the tube and folded over the opposite longitudinal edge 30 of the shell 27 and stuck to the latter. It is pointed out that the filter shell 25 and its shell portion 27 after withdrawal of the skein sheath 21 by the firm tobacco filling 22 obtain adequate stiffness for the aforementioned relative rotation with respect to the tube 31 for the subsequent adhesion operation. Alternatively, the filter shell 25 can be held fixed at the filter portion 26 and the slot tube 31 turned in the opposite direction according to the arrow G, i.e. anticlockwise in FIG. 9, the projecting adhesion edge 35, 29 of the filter shell 27 likewise thereby being folded onto the edge 30 of the filter shell and stuck to the latter. The making of the cigarette is thus concluded and the cigarette can be removed from the slot tube 31. This removal operation can possible be be facilitated by slight widening of the preferably resilient-yieldable slit tube 31 at the slot edges 33, 34 so that the finished cigarette itself drops out of the downwardly held slit tube 31.

With this other basic embodiment of the system according to the invention as described above as well it is possible in the simplest manner for the consumer to make a high-quality cigarette equivalent in every aspect to industrially manufactured finished cigarettes starting from the industrially prefabricated sheathed tobacco skein, and in accordance with the fundamental idea of the invention this is done without axial transfer of the tobacco filling from the skein sheath so that the tobacco skein in fullness and consistency remains unchanged compared with the condition in the industrial manufacture of the prefabricated product. The slit tube required by the user for making his own cigarettes represents an aid of the simplest type which moreover in its form and dimensions largely corresponds to the prefabricated product or the matching cigarette shell and is therefore well suited to be included in the packet.

The embodiment according to FIGS. 8 and 9 is primarily intended for use with a cigarette filter shell (of special type). If however the skein sheath 21 of the sheathed tobacco skein 20 consists of a (not too thick) smokable material, in particular a cigarette paper, and the non-smokability of the prefabricated product is ensured in suitable manner, for example by appropriate perforation, said prefabricated product 20 could also be used by persons rolling their own cigarettes in conjunction with a conventional cigarette paper for making the cigarette in a manner similar to that explained in FIG. 7 for the prefabricated product 1 of the embodiment according to FIGS. 1 to 7. The projecting tab 24 could then also be rolled into the outer cigarette paper.

According to a further modification illustrated in FIG. 11 the skein sheath 52 of the prefabricated product designated as a whole by 51 may be made from a smokable cigarette paper of adequate strength and sealing properties to serve as sole final cigarette shell; the non-smokability of the prefabricated product 51 is ensured by a linear perforation 53 which is disposed in the axial direction in a region of the skein sheath which is covered by the projecting tub 54 of the skein sheath 52 on placing against the skein and is thus sealed; the tab 54 may be simply placed round the skein (in the direction of the arrow T) and by moistening of the adhesive gumming 55 preferably provided at the edge of the tab 54 adhered to the outside of the skein sheath 52, closing the perforation 53, thus making in an extremely simple manner a cigarette of high quality from a prefabricated product not itself smokable by the user by "finish rolling". In FIG. 11*a* the prefabricated product 51 is shown in an embodiment for making a filterless cigarette. The prefabricated product 56 illustrated in FIG. 11*b* differs from that in FIG. 11*a* only in the additionally provided filter portion 57 such that after the folding over and adhesion of the tab 54 closing the perforation 53 in the simplest manner a filter cigarette of high quality is again obtained. The embodiment of a prefabricated product 58 illustrated in FIG. 11*c* also serves to make a filter cigarette and differs from the prefabricated product 57 illustrated in FIG. 11*b* in a firm, stiff, completely untearable metal strip which projects at the edge of the projecting tab 54 and is connected to aid tab 54 via a desired tear point 60. After covering the perforation by folding over the tab 54 according to the arrow T and adhesion the firm grip strip facilitating manipulation can then be torn off along the desired tear point 60.

Figures 12, 12A, 12B, 12C:
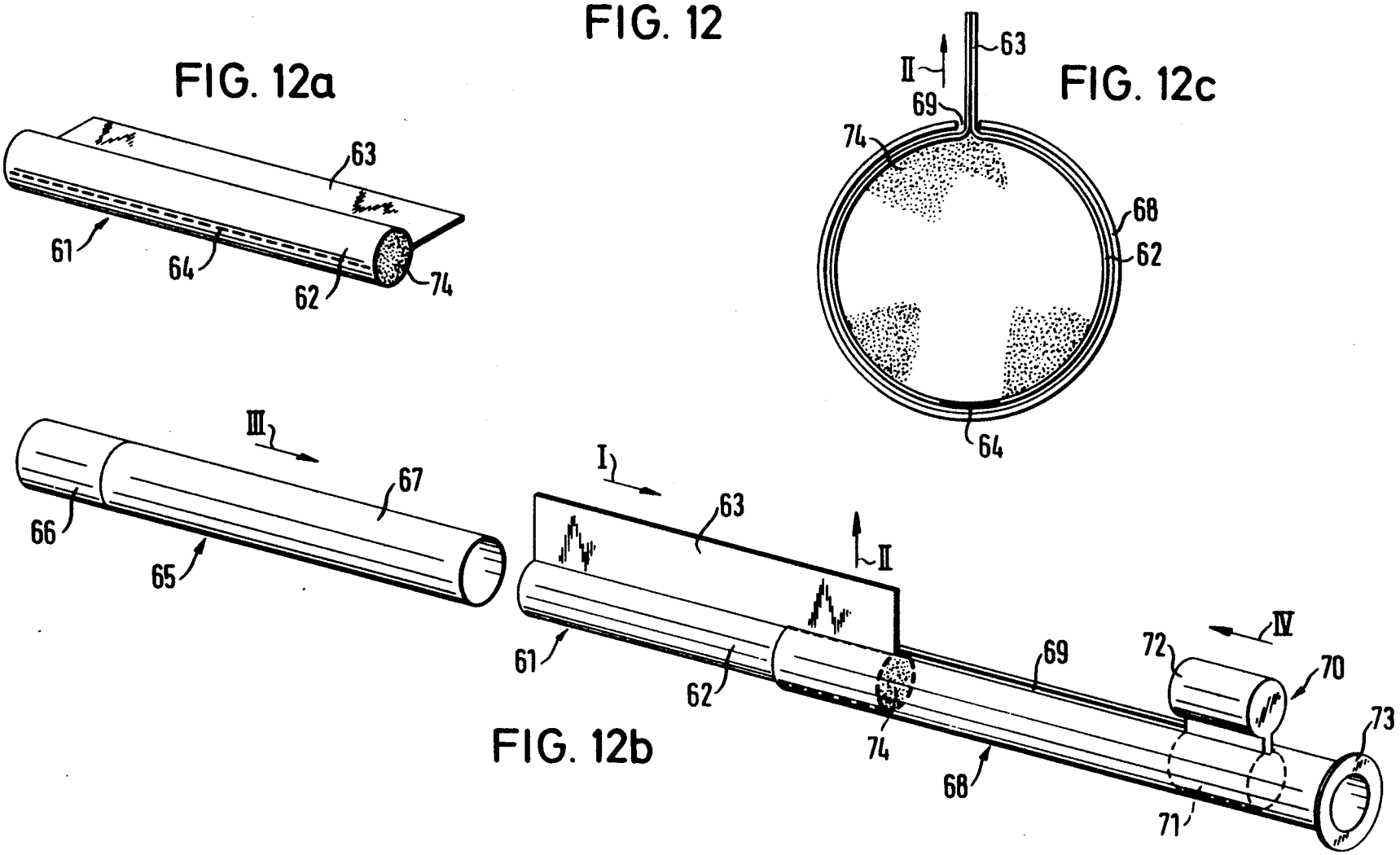

A further basic embodiment of a system according to the invention is illustrated in FIG. 12. FIG. 12*a* shows in schematic view again the industrially prefabricated sheathed tobacco skein which is designated as a whole by 61. In this embodiment the skein sheath 62 is not overlapped and adhered in the peripheral direction but the two ends of the skein sheath project radially outwardly from the peripheral point where they meet and in the radially projecting portion are adhered together to form an adequately wide grip strip 63. At the peripheral position diametrically opposite the grip tab 63 a desired tear position 64 extending in the axial direction is provided which is simultaneously formed as perforation promoting the non-smokability of the prefabricated product 61. The material of the skein sheath 62 is so chosen that, possible in conjunction with the perforation 64, non-smokability of the prefabricated product as such is ensured.

FIG. 12*b* shows the essential components of this basic embodiment of a system according to the invention in perspective; as apparent, associated with the prefabricated product 61 is a filter cigarette shell designated as a whole by 65, of conventional type, with filter portion 66 and shall portion 67 (of cigarette paper). A further associated component of this system is a thin-walled somewhat resilient-flexible tube which is designated as a whole by 68. The tube comprises on the major part of its longitudinal extent an axial longitudinal slot 69 in which a displacement plunger 70 with inner plunger portion 71 and outer grip portion 72 is longitudinally displaceable. At the non-slit end the tube 73 is outwardly beaded or otherwise made easy to grip.

The axial length of the prefabricated product 61 is slightly greater than the shell portion 67 of the filter cigarette shell 65, the diameter of the prefabricated product 61 (without the grip tab 63) is adapted to the diameter of the shell portion 67 and correspondingly the diameter of the slit tube 68 so that the prefabricated product can easily be introduced with its skein body into the tube, the grip tab 63 projecting outwardly through the slot 69 for guiding; in addition, the tube 68 is in turn adapted in diameter to the shell portion 67 of the filter cigarette shell 65 so that the shell can easily be pushed on the outside onto the slit tube, the introduction of the slit tube into the open end of the shell portion 67 possibly being facilitated by slight compression of the slit tube.

The procedure for making the cigarette with this system is as follows:

Firstly, the prefabricated product 61 is introduced in the manner indicated in FIG. 12*b* in the direction of the arrow I into the slit tube 68 until abutment against the displacement plunger 70; in this condition the prefabricated product 61 lies with its entire axial length in the slit tube 68. This condition is illustrated in cross-sectional view in FIG. 12*c*. As next step, the grip tab 63 projecting outwardly through the slot 69 is pulled outwardly in the direction of the arrow II, conveniently starting at an axial end, in such a manner that the opposite desired tear position 64 of the skein sheath is torn open and the skein sheath can be withdrawn radially from the slot 69; the tobacco filling 74 of the prefabricated product now lies without sheath in the slit tube 68. The shell 65 is then pushed with its shell portion 67 in the direction of the arrow II onto the slit tube 68 and for facilitating the insertion the slit tube is slightly compressed at its slit end. As last step the tube is now held at the grip end 73 and the tobacco filling disposed in the interior of the slit tube 68 and freed from the skein sheath is transferred by displacement of the plunger 70 in the direction of the arrow IV into the cigarette paper shell 65, 67, which is thereafter pushed from the slit tube 68 and finally drops free as firmly filled cigarette. This latter partial operation is similar to the self-stuffing known per se of cigarette shells; a difference is that by means of the prefabricated sheathed tobacco skein 61 introduceable into the slit tube and the withdrawal of the skein sheath 62 in simplest manner the consumer can obtain a uniform filling of the tube with a tobacco amount corresponding exactly to a cigarette filling. In accordance with the underlying idea of the present invention no axial ejection of the tobacco filling from the skein sheath 62, with its disadvantages referred to (stressing of the skein sheath material and resulting demands made on the formation of the skein sheath), is necessary; on the contrary, the separation of skein sheath and tobacco filling, similarly to the embodiment of FIGS. 8 and 9, is by withdrawal of the skein sheath in a radial lateral direction.

Above, various basic embodiments of a system according to the invention have been explained with the aid of preferred examples of embodiment which of course can be modified in many details without leaving the scope of the invention. All the basic embodiments and examples of embodiment described have in common the essential idea of the invention of permitting the making of the cigarette using the prefabricated sheathed tobacco skein in a manner not requiring axial ejection of the tobacco filling from the skein sheath.

I claim:

1. Product for the making of cigarettes by the consumer himself comprising:

(a) a non-smokable prefabricated product in the form of an industrially prefabricated sheathed tobacco skein, said prefabricated product comprising a skein sheath having a diameter such that it can be enclosed by an outer cigarette paper shell and having a skein-like tobacco filling corresponding to a respective cigarette portion, the non-smokability of the prefabricated product being ensured by a perforation of the skein sheath, the skein sheath consisting essentially of a combustible and smokable material, permitting the prefabricated product to remain within said enclosing outer cigarette paper shell so as to form together therewith the shell of the finished cigarette;

wherein the prefabricated product is premade with a slightly smaller diameter than that of the outer cigarette paper shell and is formed such that its diameter can be varied slightly by the user.

2. System according to claim 1, wherein the slight subsequent variability of the diameter of the prefabricated product is effected by the arrangement and formation of the perforation of the skein sheath of the prefabricated product.

3. System according to claim 2, wherein the perforation of the skein sheath is formed as a linear array of closely adjacent perforation openings.

4. System according to claim 3, wherein the perforation of the skein sheath is formed as a helical line of openings extending over the axial length of the prefabricated product.

5. System according to claim 3, wherein the perforation comprises a plurality of helical lines of openings extending in the same direction over the axial length and around the circumference of the prefabricated product.

6. System according to any one of claims 2-5, further comprising (b) a roll-your-own cigarette paper for forming an outer cigarette paper shell of the finished cigarette.

7. System according to any one of claims 2-5, further comprising (b) an outer cigarette paper shell consisting essentially of cigarette paper of a smaller thickness than that of the cigarette paper of conventional self-stuffing cigarette shells or conventional roll-your-own cigarette papers for providing that the sum of the paper thicknesses of the skein sheath and the outer cigarette paper shell corresponds substantially to the paper thickness of such a conventional cigarette shell or conventional cigarette paper.

8. System according to claim 7, wherein one insertion end of the prefabricated sheathed or enveloped tobacco skein is formed for being insertable into the outer cigarette paper shell by being slightly inwardly conically bevelled.

9. System according to claim 8, further comprising (c) a container for receiving a plurality of prefabricated sheathed tobacco skeins, the container comprising an aid for carrying out the slight conical inward bevelling of the skein sheath at the insertion end of the prefabricated product by the user.

10. System according to claim 9, wherein the container comprises a side face having defined therein a pot-shaped depression with a conical side wall corresponding to the diameter of the prefabricated product.

11. System according to claim 9, the container being formed with a pivot lid, one of the inner corners of the pivot lid being marked as a "turn-in region" for the slightly conical inward bevelling of the skein sheath of the insertion end of the prefabricated product by the user.

12. System according to claim 1, wherein the outer cigarette paper shell forms a cigarette shell, the outer cigarette paper shall being formed with an unadhered portion which projects outwardly therefrom and includes an adhesion edge, such that after the insertion of the prefabricated sheathed tobacco skein into the paper shell, the unadhered portion is foldable onto another portion of the paper shell and adhered to the latter by adhesion of the adhesion edge to the other portion of the paper shell with tight engagement of the adhered cigarette paper shell against the skein sheath of the prefabricated product for tightly covering the perforations therein.

13. Product according to claim 12, wherein the outer cigarette paper shell further comprises a filter.

14. Product according to claim 1, wherein the skein sheath consists essentially of cigarette paper.

15. System for the making of cigarettes by the consumer himself comprising (a) a non-smokable prefabricated product in the form of an industrially prefabricated sheathed tobacco skein, said prefabricated product comprising a skein sheath adapted in its diameter to be inserted into an outer cigarette paper shell of the finished cigarette and having a skein-like tobacco filling corresponding to a particular cigarette portion, (b) a filter cigarette shell having a filter portion and a shell portion which forms said outer cigarette paper shell of the finished cigarette, the skein sheath of the prefabricated sheathed tobacco skein being formed with a tab portion projecting outwardly from its closed periphery, the filter cigarette shell being formed at least over its shell portion with an axial elongated slot from which one edge projects outwardly said edge having adhesion means thereon, and (c) an aid for the making of the cigarette by the consumer himself from the sheathed tobacco skein and the filter cigarette shell, said aid comprising a tube provided with a longitudinal slot and consisting essentially of a resilient flexible materials, whose axial length corresponds substantially to the length of the sheathed tobacco skein and of the shell portion of the filter cigarette shell.

16. System according to claim 15, wherein the tab portion projecting from the periphery of the skein sheath of the prefabricated product is formed integrally with the skein sheath and extends outwardly from an axial adhesion or fusion seam of the skein sheath.

17. System according to claim 16, wherein the skein sheath of the prefabricated product comprises adjacent the adhesion or fusion seam in an inner surface of the skein sheath material a desired tear point.

18. System according to any one of claims 15 to 17, wherein the skein sheath of the prefabricated product consists essentially of a non-combustible and/or non-smokable material.

19. System according to claim 18, wherein the skein sheath of the prefabricated product is provided with a perforation for ensuring the non-smokability of the prefabricated product.

20. System according to claim 15, wherein the slotted tube has at the opposing longitudinal edges of the slot portions which are slightly outwardly bent and rounded.

21. Method for the making of cigarettes by the consumer himself, comprising the following method steps:

introducing a prefabricated sheathed or enveloped tobacco skein into a shell portion of a filter cigarette shell in an axial direction in such a manner that a tab or tongue portion which projects outwardly from the closed periphery of the sheathed tobacco skein of the prefabricated product and has an adhesion edge with adhesion means thereon, projects outwardly through a longitudinal slot of the shell portion of the cigarette filter shell, introducing the cigarette filter shell with the prefabricated product inserted therein in an axial direction into a slotted tube so that the tab or tongue portion projection from the periphery of the skein sheath of the prefabricated product through the slot of the shell portion of the cigarette filter shell, and the adhesion edge of the shell portion of the cigarette filter shell projecting from the periphery of the cigarette shell, outwardly project through the longitudinal slot of the slotted tube, the introduction in the axial direction being effected to such an extent that the prefabricated product with the cigarette paper shell surrounding it are enclosed in the slotted tube whilst the filter portion of the cigarette filter shell projections from one end of thee slotted tube, pulling outwardly on the outwardly projection tab or tongue portion of the skein sheath of the prefabricated product so as to separate an adhesion or fusion seam and/or a desired tear point of the skein sheath, further pulling the tab or tongue portion to withdraw the skein sheath completely from the longitudinal slots of the slotted tube and the cigarette paper shell outwardly, and turning the slotted tube with respect to the cigarette filter shell so as to fold over the outwardly projecting adhesion edge of the cigarette paper shell inwardly to coincide with another slot edge of the cigarette paper shell and to stick it to the latter by means of the adhesive layer.

22. Product for the making of cigarettes by the consumer himself comprising:

(a) a non-smokable prefabricated product in the form of an industrially prefabricated sheathed tobacco skein with a skein-like tobacco filling corresponding to a particular cigarette portion, the nonsmokability of the pre-fabricated product being ensured by a perforation of the skein sheath, wherein the skein sheath consists essentially of a combustible and smokable material, in particular a cigarette paper of covnentional thickness, and is formed with a tab portion which projects outwardly from the closed periphery of the skein sheath and which is adapted to be folded onto the outside of the region of the skein sheath adjacent to the tab portion and adhered to the latter, and the perforation is provided in the peripheral region of the skein sheath and upon subsequent folding over the initially projecting tab portion is covered by the latter, such that by simple folding over and adhering of the initially projecting tab portion to the outside of the skein sheath the perforation is sealed and a finished smokable cigarette is obtained.

23. Product according to claim 22, wherein the prefabricated sheathed tobacco skein further comprises a filter portion at one end fact thereof.

24. Product according to claim 22 or claim 23, wherein the initially projecting tab portion of the skein sheath is provided over a desired tear position with a reinforced metal strip which consists of non-combustible and non-smokable material and is adapted to be torn off after the folding over and adhering.

25. System for the making of cigarettes by the consumer himself comprising:

(a) a non-smokable prefabricated product in the form of an industrially prefabricated sheathed tobacco skein, said prefabricated product comprising a skein sheath adapted in its diameter to be inserted into an outer cigarette paper shell of the finished cigarette with a skein-like tobacco filling corresponding to a particular cigarette portion, (b) a filter cigarette shell having a filter portion and a shell portion which forms said outer cigarette paper shell of the finished cigarette, the skein sheath of the prefabricated sheathed tobacco skein being formed with a grip tab of adequate gripping width projecting radially from its peripheral region opposite the grip tab with an axial desired tear point, and (c) and aid for the making of the cigarette by the consumer himself from the sheathed tobacco skein and the filter cigarette shell, said aid comprising a tue provided on a portion of its length with a slot and consisting essentially of a resilient flexible material, of which a displacement plunger is guided longitudinally displaceably from an initial end position, the axial length of the slotted region not occupied by the displacement plunger in its initial end position corresponding substantially to the length of the sheathed tobacco skein and of the shell portion of the filter cigarette shell.

26. System according to claim 25, wherein the slotted tube is formed at an unslotted end face thereof with a grippable edge.

27. Method for the making of cigarettes by the consumer himself, comprising the following method steps:

introducing a prefabricated sheathed or enveloped tobacco skein into a slotted portion of a slotted tube, a grip tab of the prefabricated product projecting outwardly through the slot;

tearing open a desired tear point of the skein sheath by pulling outwardly on the grip tab of the skein sheath projecting through the slot, and withdrawing the separated skein sheath outwardly through the slot;

pushing a shell portion of a filter cigarette shell onto the slotted region of the slotted tube; and ejecting a tobacco filling, freed by said tearing and with drawing steps from the skein sheath fro transfer thereof, into the cigarette paper shell, by displacing a displacement plunger in the slotted tube in the direction (arrow IV, FIG. 12*b*) of the filter cigarette shell.

* * * * *